US006832963B2

(12) United States Patent
Sullivan et al.

(10) Patent No.: US 6,832,963 B2
(45) Date of Patent: Dec. 21, 2004

(54) GOLF BALL COVERS COMPRISING MODULUS ADJUSTING FILLERS

(75) Inventors: Michael J. Sullivan, Barrington, RI (US); Derek A. Ladd, Fairhaven, MA (US); Antonio U. DeSimas, East Providence, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/317,904

(22) Filed: Dec. 12, 2002

(65) Prior Publication Data

US 2003/0092509 A1 May 15, 2003

Related U.S. Application Data

(63) Continuation-in-part of application No. 09/842,574, filed on Apr. 26, 2001, and a continuation-in-part of application No. 09/815,753, filed on Mar. 23, 2001, now Pat. No. 6,494,795.

(51) Int. Cl.[7] ..... A63B 37/04; A63B 37/06; A63B 37/12; A63B 37/14

(52) U.S. Cl. ..... 473/374; 473/378

(58) Field of Search ..... 473/351–378

(56) References Cited

U.S. PATENT DOCUMENTS

| | | | | |
|---|---|---|---|---|
| 4,625,964 A | | 12/1986 | Yamada | |
| 5,048,838 A | | 9/1991 | Chikaraishi et al. | |
| 5,104,126 A | | 4/1992 | Gentiluomo | |
| 5,482,285 A | | 1/1996 | Yabuki et al. | |
| 5,779,561 A | * | 7/1998 | Sullivan et al. | 473/373 |
| 5,823,889 A | | 10/1998 | Aoyama | 473/374 |
| 5,824,746 A | | 10/1998 | Harris et al. | 525/196 |
| 5,885,172 A | | 3/1999 | Hebert et al. | 473/354 |
| 5,919,100 A | | 7/1999 | Boehm et al. | 473/354 |
| 5,947,843 A | | 9/1999 | Calabria et al. | 473/377 |
| 5,984,806 A | * | 11/1999 | Sullivan et al. | 473/373 |
| 5,989,136 A | | 11/1999 | Renard et al. | 473/376 |
| 5,993,968 A | | 11/1999 | Umezawa et al. | 428/407 |
| 6,010,411 A | | 1/2000 | Reyes | 473/345 |
| 6,015,356 A | | 1/2000 | Sullivan et al. | 473/373 |
| 6,025,442 A | | 2/2000 | Harris et al. | 525/221 |
| 6,030,296 A | | 2/2000 | Morgan et al. | 473/361 |
| 6,120,393 A | | 9/2000 | Sullivan et al. | 473/377 |
| 6,142,887 A | | 11/2000 | Sullivan et al. | 473/374 |
| 6,149,535 A | | 11/2000 | Bissonnette et al. | 473/354 |
| 6,152,834 A | | 11/2000 | Sullivan | 473/365 |
| 6,183,382 B1 | | 2/2001 | Kim et al. | 473/374 |
| 6,261,193 B1 | * | 7/2001 | Sullivan et al. | 473/377 |
| 6,315,681 B1 | * | 11/2001 | Sullivan | 473/373 |
| 6,413,172 B1 | * | 7/2002 | Binette | 473/378 |
| 2001/0019969 A1 | | 9/2001 | Binette et al. | 473/354 |
| 2002/0013185 A1 | | 1/2002 | Sullivan et al. | 473/373 |
| 2002/0034989 A1 | | 3/2002 | Sullivan et al. | 473/373 |

FOREIGN PATENT DOCUMENTS

| | | |
|---|---|---|
| WO | 00/23519 | 4/2000 |
| WO | 00/57962 | 10/2000 |

OTHER PUBLICATIONS

"Optema Properties Data Sheet" Exxon Mobil, copyright 2003.*

* cited by examiner

*Primary Examiner*—Gregory Vidovich
*Assistant Examiner*—Alvin A. Hunter, Jr.

(57) ABSTRACT

The present invention is directed to a golf ball with a core and a polymeric layer reinforced with fillers. Such layer can be the cover, a portion of the cover, an intermediate layer, a portion of the intermediate layer, or any layer in the golf ball. The fillers are selected to provide efficient increases in flexural modulus as a function of weight percentage of filler in the polymeric layer. A preferred filler is barium sulfate.

15 Claims, 3 Drawing Sheets

Weight % Filler in Nucrel 960

GOLF BALL COVERS COMPRISING MODULUS ADJUSTING FILLERS

RELATED APPLICATIONS

This application is a continuation-in-part of patent application entitled "Golf Ball and a Method for Controlling the Spin Rate of Same," bearing Ser. No. 09/815,753 filed on Mar. 23, 2001, now U.S. Pat. No. 6,494,795, and a continuation-in-part of co-pending patent application entitled "Golf Ball" bearing Ser. No. 09/842,574 filed on Apr. 26, 2001. The parent applications are incorporated by reference herein in their entireties.

TECHNICAL FIELD OF INVENTION

The present invention generally relates to a golf ball having a layer containing reinforced fillers. The present invention is also directed to a golf ball including a layer reinforced with fillers to increase its flexural modulus and moment of inertia.

BACKGROUND OF THE INVENTION

Conventional golf balls have primarily two functional components: the core and the cover. The primary purpose of the core is to be the "spring" of the ball or the principal source of resiliency. The core may be solid or wound. The primary purpose of the cover is to protect the core. Multi-layer solid balls include multi-layer core constructions or multi-layer cover constructions, and combinations thereof. In a golf ball with a multi-layer core, the principal source of resiliency is the multi-layer core. In a golf ball with a multi-layer cover, the principal source of resiliency is the single-layer core.

Two-layer solid balls are made with a single-solid core, typically a cross-linked polybutadiene or other rubber, encased by a hard cover material. Increasing the cross-link density of the core material can increase the resiliency of the core. As the resiliency increases, however, the compression may also increase making the ball stiffer, thereby increasing driver spin rates. In an effort to make golf balls with improved performance characteristics, manufacturers have used thermoplastics in various layers in multi-layer golf balls. Some thermoplastic materials have a low flexural modulus, such that layers formed therefrom produce golf balls with driver spin rates at higher than desirable levels. Such high spin rates, although allowing a more skilled player to maximize control of the golf ball, can also cause golf balls to have severely parabolic trajectories and do not achieve sufficient distance. Thus, manufacturers often try to strike a balance between spin rate and distance. By adding fillers in thermoplastic layers, the flexural modulus or stiffness of such layers increases, so that the golf balls produced have lower spin rates and can achieve greater distances. However, a need still exists for a golf ball with a filled thermoplastic layer that strikes a balance between high flexural modulus (for lower driver spin) and the amount of fillers required to achieve such modulus.

SUMMARY OF THE INVENTION

Accordingly, the present invention is directed to a golf ball with a core and a polymeric layer reinforced with fillers.

The present invention is also directed to a golf ball with a layer comprising fillers embedded in a polymeric matrix to increase the flexural modulus of the thermoplastic matrix. This layer preferably also increases the rotational moment of inertia for the ball to further reduce its driver spin rate. This layer can be the cover, a portion of the cover, an intermediate layer, a portion of the intermediate layer, or any layer in the golf ball.

The present invention is directed to a golf ball comprising a core encased by an outer layer wherein the outer layer comprises a thermoplastic matrix material having flexural modulus from about 500 psi to about 30,000 psi and a filler, wherein at least about 30% by weight of the filler provides at least about 50% increase in the flexural modulus in the outer layer as compared to the unfilled thermoplastic matrix.

In accordance to another aspect of the present invention, when at least about 50% of the filler is added to the thermoplastic matrix, the flexural modulus in the outer layer is increased by at least about 90%. In accordance to yet another aspect of the present invention, when at least about 80% of the filler is added, flexural modulus in the outer layer is increased by at least about 600%.

Preferably the thermoplastic matrix material comprises a copolymer of ethylene and a carboxylic acid, wherein the carboxylic acid can be methacrylic acid, acrylic acid or maleic acid. The acid level ranges from about 3% to about 25%, more preferably from about 4% to about 15%, and more preferably from about 7% to about 11%.

Preferably, the filler comprises barium sulfate.

Preferably, the filler increases the rotational moment of inertia of the ball.

The thickness of the outer layer ranges from about 0.005 inch to about 0.030 inch, and more preferably the thickness of the outer layer is about 0.0150 inch. The outer layer can be a cover layer or an intermediate layer.

DETAILED DESCRIPTION OF THE PREFERRED EMBODIMENTS

Figure 1:
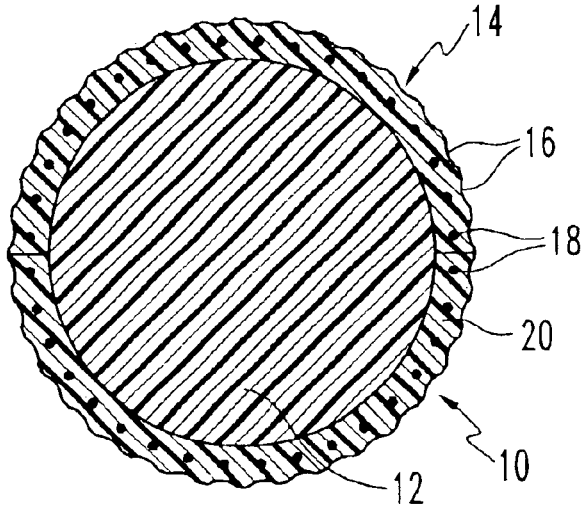
FIG. 1 is a cross-sectional view of a first embodiment of a golf ball of the present invention.

Referring to FIG. 1, golf ball 10 includes a core 12 surrounded by at least one cover layer 14 made from a filler-reinforced polymer. Core 12 may have any dimension or composition, such as thermoset rubber, thermoplastic, metal, or any material known to one skilled in the art of golf ball manufacture. Core 12 can be a solid core, a two-layer core with a molded or wound outer core layer and a solid or fluid-filled center, or a multi-layer core, as known by those of ordinary skill in the art. Preferably, the core 12 comprises a resilient polymer such as polybutadiene, natural rubber, polyisoprene, styrene-butadiene, or ethylene-propylene-diene rubber or highly neutralized polymers. This base material may be combined with other components as known by one of ordinary skill in the art. The base composition can be mixed and formed using conventional techniques to produce the core 12. Any core or cover materials disclosed in the parent applications can be used with the present invention. The disclosures of the parent applications have been incorporated by reference in their entireties.

Figure 2:
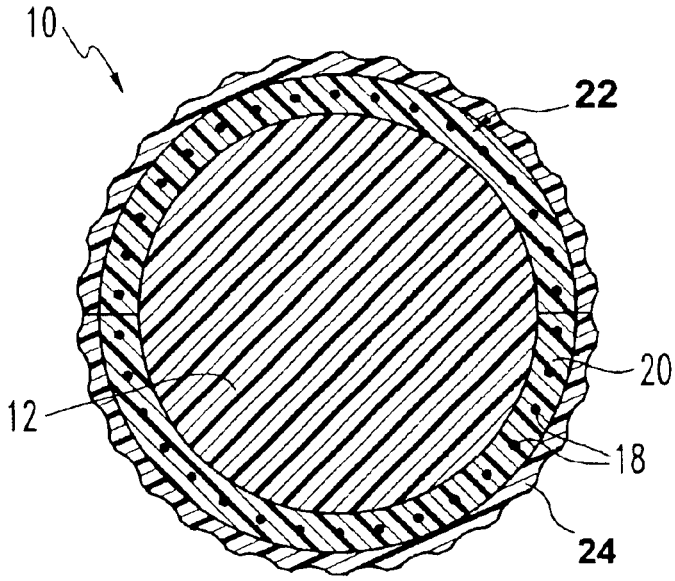
FIGS. 2–3 are cross-sectional views of additional embodiments of golf balls of the present invention, respectively.
Figure 3:
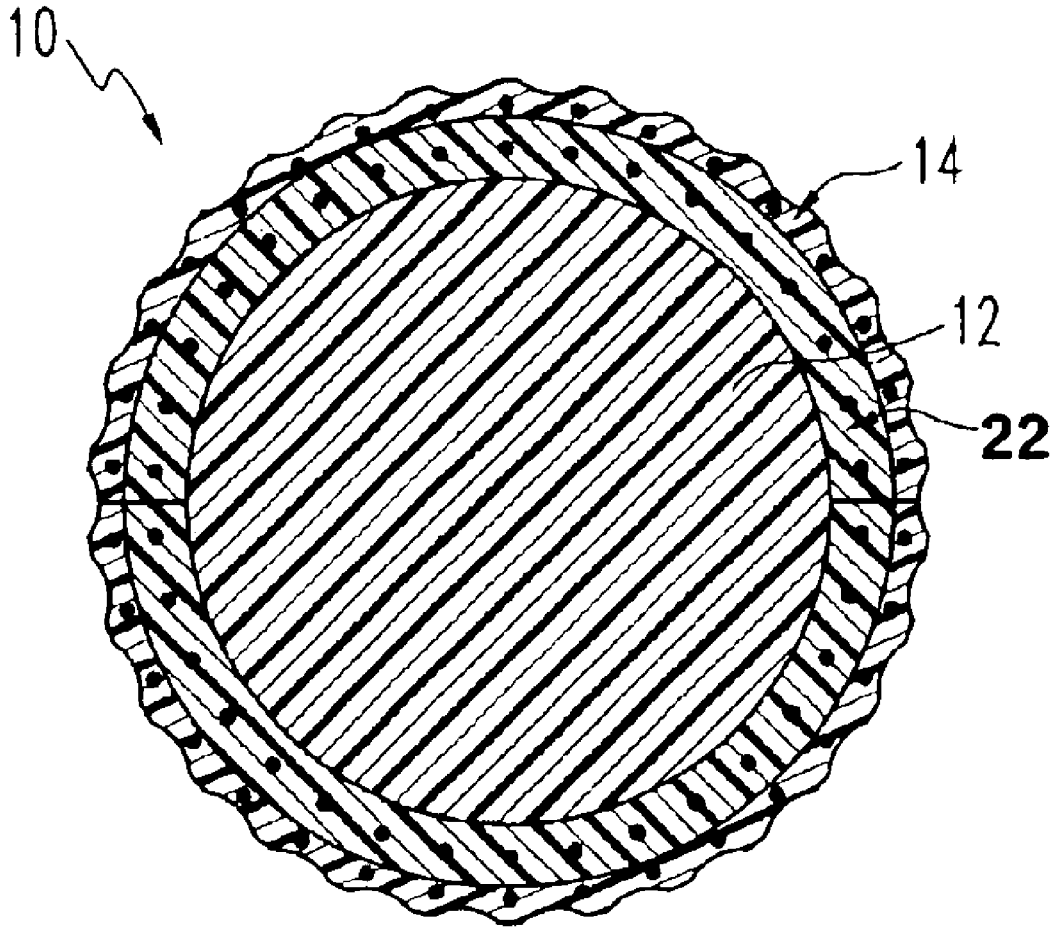

Cover layer 14 is preferably formed with a plurality of dimples 16 or surface protrusions defined on the outer surface thereof. The polymer forming the cover layer 14 includes fillers 18 embedded in a polymeric matrix or binder material 20. As illustrated in FIG. 1, the filler-reinforced polymer is utilized in layer 14, which is a single-layer cover. The filler-reinforced polymer may be utilized in any layer or layers in the golf ball, as illustrated in FIGS. 2–3 and discussed further below.

As used herein, the term "fillers" includes any compound or composition that can be used to vary the density and other properties of the subject golf ball core and/or cover. Fillers useful in the golf ball core according to the present invention include, for example, metal (or metal alloy) powders, metal oxide, metal searates, particulate, carbonaceous materials, and the like or blends thereof. The amount and type of fillers utilized is governed by the amount and weight of other ingredients in the composition, since a maximum golf ball weight of 1.620 ounces (45.92 gm) has been established by the United States Golf Association (USGA).

Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Examples of metal oxides include but are not limited to zinc oxide, iron oxide, aluminum oxide, titanium dioxide, magnesium oxide, zirconium oxide, and tungsten trioxide. Examples of particulate carbonaceous materials include but are not limited to graphite and carbon black. Examples of other useful fillers include but are not limited to graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled uncured polymeric material mixed and ground to 30 mesh particle size), manganese powder, and magnesium powder.

To increase the rotational moment of inertia of the ball, preferably the fillers have specific gravity of greater than 2.0 and can be as high as 20.0. As discussed in the parent patent applications, the high rotational moment of inertia reduces the driver spin rate of the golf ball. To decrease the rotational moment of inertia of the ball, the fillers may have specific gravity of less than 1.0, such as syntactic foam with hollow spheres or microspheres. The low rotational moment of inertia increases the driver spin rate of the ball.

Preferably, fillers 18 are either tungsten or barium sulfate. More preferably, fillers 18 are barium sulfate. Tungsten powder has a specific gravity of about 15 to about 19.5 depending the purity and oxide content, and barium sulfate has a specific gravity of about 4.6. These fillers advantageously have high specific gravity to provide the cover more mass and the ball higher rotational moment of inertia. Also, as shown in the test results presented below, these fillers also significantly increase the flexural modulus of the polymeric matrix at low concentration.

Preferably, the matrix material 20 is selected such that cover layer 14 has acceptable high flexural modulus for low driver spin and high impact resistance, but also provides an outer surface with sufficient friction to impart adequate spin on the ball for greenside performance. Preferably, matrix material 20 is a thermoplastic polymer. Advantageously, fillers 18 increase the flexural modulus, as well as the hardness of cover layer 14. Moreover, adding fillers 18 to a thermoplastic polymer increases its flexural modulus, and makes the thermoplastic suitable for use in an outer layer of the golf ball. For example, polyethylene methacrylic acid resins or other non-ionomers, which have desirable properties such as low water vapor transmission rate and high melt flow index, can be improved by incorporating fillers 18 therein to increase its flexural modulus and hardness without unnecessarily increase spin, as shown in the test results discussed below. Another advantage is that such outer layers can be made very thin, preferably in the range of 0.005 inch to 0.030 inch and preferably about 0.015 inch, so that a very large core 12 can be employed. A large core is desirable, because it is the principal source of resilience and coefficient of restitution of the golf ball.

Preferred thermoplastic matrix material 20 include those that have low flexural modulus, in the range of about 500 psi and about 30,000 psi, relatively high spin. As stated above, these matrix materials are improved by reinforcement with fillers 18. Fillers 18 increase the flexural modulus to reduce spin. Additionally, the preferred high specific gravity fillers, e.g., barium sulfate, further increase the moment of inertia to reduce driver spin. The flexual modulus of these materials can be increased significantly by the filler. Preferably, the flexual modulus is increased to between about 19,000 psi and 120,000 psi. More preferably, the flexual modulus is increased to between about 30,000 psi and 100,000 psi.

Suitable low flexural modulus, relatively low resilience and high spin thermoplastics include, but are not limited to, thermoplastic urethanes and polyethylene methacrylic acid resins commercially available as Nucrel® from DuPont. Additional suitable thermoplastics include copolymers of ethylene and methacrylic acid having an acid level from about 3% to about 25% by weight. More preferably, the acid level ranges from about 4% to about 15%, and most preferably from about 7% to about 11%. Copolymers of ethylene and methacrylic acid have an advantage in that these compounds typically have high melt flow index. Other suitable thermoplastics include copolymers of ethylene and a carboxylic acid, or terpolymers of ethylene, a softening acrylate class ester such as methyl acrylate, n-butyl-acrylate or iso-butyl-acrylate, and a carboxylic acid. Exemplary carboxylic acids are acrylic acid, methacrylic acid or maleic acid. Exemplary softening acrylate class esters are methyl acrylate, n-butyl-acrylate or iso-butyl-acrylate. Examples of such terpolymers include polyethylene-methacrylic acid-n or iso-butyl acrylate and polyethylene-acrylic acid-methyl acrylate, polyethylene ethyl or methyl acrylate, polyethylene vinyl acetate, polyethylene glycidyl alkyl acrylates. Other suitable low flexural modulus thermoplastics include "very low modulus acid copolymer ionomer" or VLMI, wherein the copolymer contains about 10% by weight of acid and 10–90% of the acid is neutralized by sodium, zinc or lithium ions. The VLMI has flexural modulus of about 2,000 to 8,000 psi. Suitable VLMIs include Surlyn® 8320 (Na), Surlyn® 9320(Zn) and Surlyn® 8120(Na). These high acid copolymer ionomers and VLMIs are described in U.S. Pat. No. 6,197,884.

A benefit of using these thermoplastics is that a very thin layer with low water vapor transmission rate can be obtained. The benefits of higher melt flow index include easier extrusion, higher extrusion rate, higher flow during heat sealing, and the ability to make thin cover layers or thin films. Without limiting the present invention to any particular theory, materials with relatively high melt flow index have relatively low viscosity. Low viscosity helps the materials spread evenly and thinly to produce a thin film.

Additionally, other suitable thermoplastics include polyethylene, polystyrene, polypropylene, thermoplastic polyesters, acetal, polyamides including semicrystalline polyamide, polycarbonate (PC), shape memory polymers, polyvinyl chloride (PVC), trans-polybutadiene, liquid crystalline polymers, polyether ketone (PEEK), bio(maleimide), and polysulfone resins. Other preferred thermoplastics for forming the matrix 20 include other Surlyn® from DuPont and, single-site catalyzed polymers including non-metallocene and metallocene, polyurethane, polyurea, or a combination of the foregoing. Suitable polymeric materials also include those listed in U.S. Pat. Nos. 6,187,864, 6,232,400, 6,245,862, 6,290,611 and 6,142,887 and in PCT publication no. WO 01/29129, which are incorporated herein by reference in their entirety. Suitable materials are also disclosed in a patent application entitled "Golf Ball with Vapor Barrier Layer," bearing application Ser. No. 10/077,081, filed on Feb. 15, 2002. The disclosures of this application are incorporated by reference herein in its entirety.

The matrix 20 can also be formed of at least one ionomer, ionomer blends, non-ionomers or non-ionomer blends. For example, the matrix 20 can include highly neutralized polymers as disclosed in WO 01/29129 incorporated by reference herein in its entirety. The matrix 20 can also be formed of combinations of the above-described matrix materials, including terpolymers of ethylene, methyl acrylate and acrylic acid (EMAAA), commercially available under the tradename Escort® Acid Terpolymers from Exxon Mobile Chemical.

The specific formulations of these matrix materials may include additives, other fillers, inhibitors, catalysts and accelerators, and cure systems depending on the desired performance characteristics.

The fillers and/or the matrix can be optionally surface treated with a suitable coupling agent, bonding agent or binder. This coupling agent improves the adhesion between the fillers and the polymeric matrix and reduces the number of voids present in the matrix material. A void is an undesirable air pocket in the matrix that does not support the fillers. Unsupported fillers under a load may buckle and transfer the stresses to the matrix, which could crack the matrix. The coupling agents can be functional monomers, oligomers and polymers. The functional groups include, but are not limited to, maleic anhydride, maleimide, epoxy, hydroxy amine, silane, titanates, zirconates, and aluminates.

As stated above, the filler-reinforced layer can be cover layer 14, as illustrated in FIG. 1, or one or more layers in the golf ball. For example, as illustrated in FIG. 2, golf ball 10 includes core 12 and an intermediate layer 22 disposed thereon, and a cover 24. The intermediate layer 22 includes a plurality of fillers 18 embedded in matrix material 20, as described with respect to cover layer 14. Preferably, the intermediate layer 22 is made either by compression molding two shells around core 12. Cover layer 24 can be formed from conventional cover compositions using techniques known by those of ordinary skill in the art, and in this embodiment contains no reinforced fillers. Cover layer 22 may be formed of conventional cover layer materials such as balata, at least one ionomer, ionomer blends, non-ionomers or non-ionomer blends. For example, the cover can include highly neutralized polymers disclosed in WO 01/29129. Cover layer 24 can also be formed of single-site catalyzed polymers including non-metallocene and metallocene catalyzed polyurethane, polyurea, or a combination of the foregoing. Alternatively, in the embodiment shown in FIG. 3 golf ball 10 has core 12 and filler-reinforced intermediate layer 22 disposed thereon and filler-reinforced cover 14.

The present invention can be better understood by the examples described below. It is noted, however, that the present invention is not limited by these examples. Barium sulfate and tungsten fillers are added to Nucrel® 960 available from DuPont in amounts shown in Tables 1 and 2 below. The reinforced Nucrel® is utilized as the intermediate layer having a thickness of about 0.015 inch, such as the embodiment described in connection with FIG. 2. The core has a diameter of about 1.59 inches and made of a polybutadiene based polymer. The outer cover can be either polyurethane or polyurea and has a thickness of about 0.030 inch.

TABLE 1

Barium Sulfate Fillers in Nucrel ® 960

| | | | | | |
|---|---|---|---|---|---|
| Weight % | 0% | 28.3% | 53.4% | 66.4% | 78.8% |
| Volume % | 0% | 9.97% | 24.33% | 35.67% | 51.05% |
| S.G. | 0.94 | 1.18 | 1.52 | 1.8 | 2.17 |
| Flex 2 wks (kpsi) | 13.5 | 19.3 | 31.5 | 50.1 | 94.4 |
| Hardness 2 wks | 45.5 | 50.1 | 56.7 | 61.2 | 65.8 |
| Gain in Flex % | 0% | 43.0% | 133.3% | 271.1% | 599.3% |

TABLE 2

Tungsten Fillers in Nucrel ® 960

| | | | | | |
|---|---|---|---|---|---|
| Weight % | 0% | 23.8% | 45.1% | 53.6% | 62.3% |
| Volume % | 0% | 1.91% | 4.87% | 6.71% | 9.33% |
| S.G. | 0.94 | 1.21 | 1.63 | 1.89 | 2.26 |
| Flex 2 wks | 13.5 | 16 | 17.5 | 19 | 20.8 |
| Hardness 2 wks | 45.5 | 47.8 | 49.7 | 51.2 | 52.2 |
| Gain in Flex % | 0% | 18.5% | 29.6% | 40.7% | 54.1% |

Figure 4:
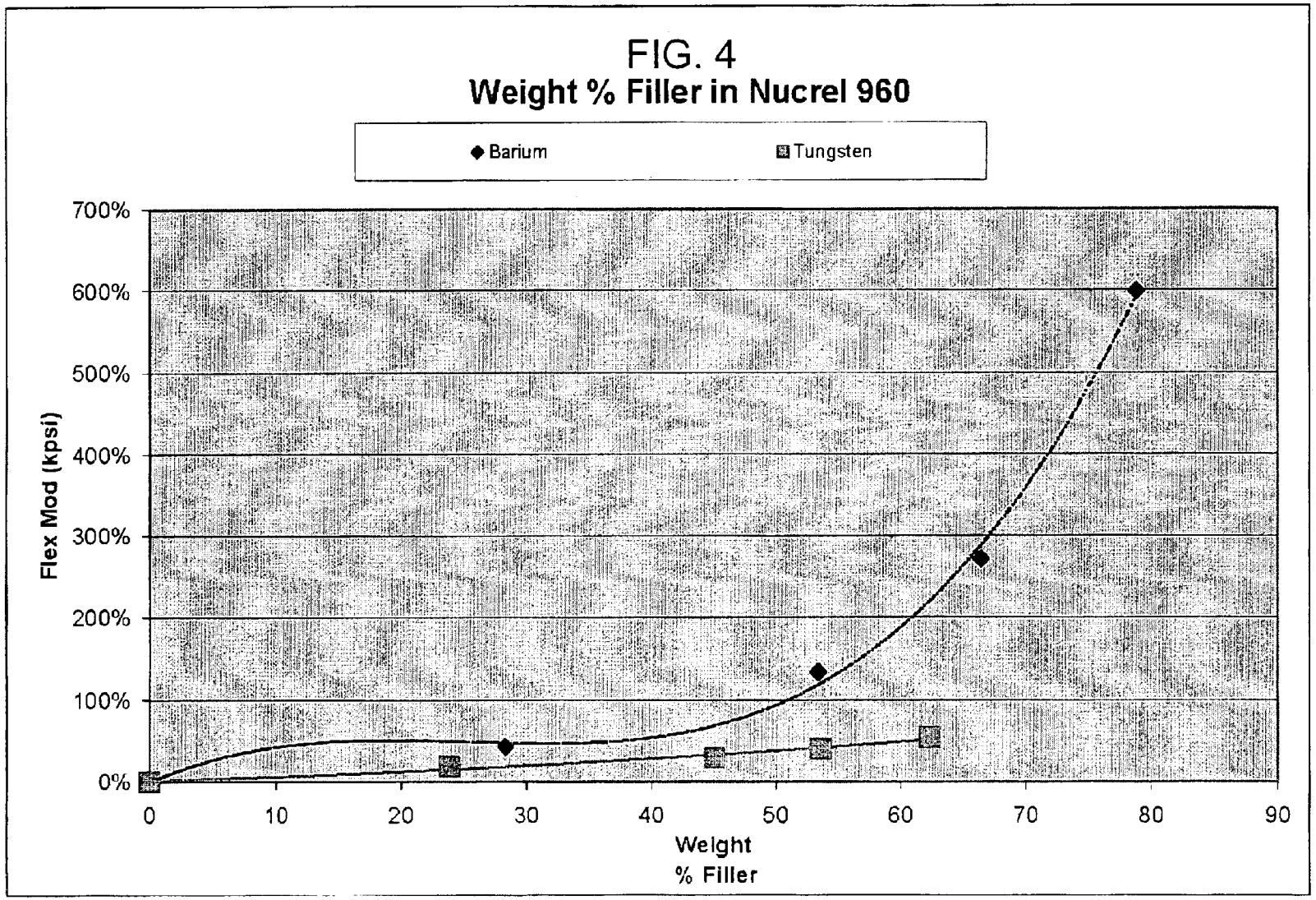
FIG. 4 is an X–Y plot of the percentage increase in flexural modulus as a function of weight percentage of the polymer matrix for selected fillers.

Flexural modulus is measured thousands of pounds per square inch (kspi) in accordance to ASTM D-6272 about two weeks after the test specimen are prepared. In Tables 1 and 2, the flexural modulus is also measured at 40 hours after the specimen were prepared to show the variation in flexural modulus. Hardness is measured on Shore D scale in accordance to ASTM D 2240-00 standard As shown in these test results, relatively low weight percentages of the barium sulfate fillers provide higher percentage of gain in flexural modulus. Due to the 1.62 ounce-limit for golf balls, the weight percentage of filler is more relevant than volume percentage. The weight percentages of these fillers are plotted as a function of the percentages gain in flexural modulus shown in FIG. 4. As shown, at about 30% by weight, barium sulfate fillers have achieved at least about 50% gain in flexural modulus. In contrast, to gain a comparable percentage of flexural modulus would require more than 60% by weight of tungsten. Advantageously, at weight percentage of more than about 50%, barium sulfate fillers can provide at least about 90% gain in flexural modulus. At about 80% of the weight, barium sulfate fillers can provide in excess of 600% gain in flexural modulus.

The test results in Tables 1 and 2 further show that the hardness, as measured on the Shore D scale, also increases as more fillers are added to the polymeric matrix. Moreover, barium sulfate fillers increase the hardness of the polymeric matrix more than tungsten fillers on a weight percentage basis.

Without undue experimentation, one of ordinary skills in the golf ball art can conduct similar tests on other suitable fillers listed herein in accordance to the present invention to determine the best suited for the thermoplastic matrix selected.

In a preferred embodiment, "prototype" golf balls comprise a 1.590 inch core made of polybutadiene based polymer having a specific gravity of about 1.05, an intermediate layer having a thickness of about 0.015 inch and made of Nucrel® 960 and about 75%–78% by weight of barium sulfate with a specific gravity of about 2.0, and an outer cover having a thickness of about 0.030 inch and made of polyurethane. These prototype balls were tested against the Pinnacle Gold Distance (PGD) balls, the Titleist Pro-V1 balls and "control" balls with virgin Nucrel® 960 intermediate layer. The test results are shown in Table 3 below:

TABLE 3

Performance Test Results

| | Standard Set-up | | Full Wedge Set-up | | Half Wedge Set-up | |
|---|---|---|---|---|---|---|
| BALLS | Speed | Spin | Speed | Spin | Speed | Spin |
| Prototype | 139.8 | 3426 | 93.8 | 9403 | 52.4 | 6752 |
| Control | 140.7 | 3673 | 95.0 | 10120 | 53.3 | 7304 |
| PGD | 141.7 | 2916 | 94.1 | 8662 | 52.3 | 5519 |
| Pro-V1 | 141.7 | 3232 | 95.1 | 9403 | 53.3 | 6848 |

Speeds are measured in feet per second and spins are measured in revolutions per minute. As used in these tests, the club "set-ups" are conditioned to pre-set launch conditions, i.e., at a club head speed to which a mechanical golf club has been adjusted so as to generate a selected ball speed. The standard set up refers to a ball speed at launch conditions of about 160 feet per second. The full wedge set up refers to a ball speed at launch conditions of about 95 feet per second and the half wedge set up refers to ball speed at launch conditions of about 53 feet per second.

As shown in Table 3, the spin rates of the prototype balls are consistently less than the control balls indicating that the increase in flexural modulus of the intermediate layer and the increase moment of inertia due to the high specific gravity of barium sulfate reduce the spin of the ball and thereby achieve the objectives of this invention. The spin rates of the prototypes are comparable to those of the Pro-V1 balls and are higher than those of the Pinnacle Gold Distance balls.

While the above invention has been described with reference to certain preferred embodiments, it should be kept in mind that the scope of the present invention is not limited to these embodiments. One skilled in the art may find variations of these preferred embodiments, which, nevertheless, fall within the spirit of the present invention, whose scope is defined by the claims set forth below.

What is claimed is:

1. A golf ball comprising a core encased by an outer layer wherein the outer layer comprises a non-ionomeric thermoplastic copolymer of ethylene and a carboxylic acid having a flexural modulus from about 500 psi to about 30,000 psi and at least about 30% by weight of a filler, wherein the filler provides at least about 50% increase in the flexural modulus of the outer layer over the same material excluding the filler and wherein the acid level ranges from about 7% to about 11%.

2. The golf ball of claim 1, wherein the outer layer comprises at least about 50% by weight of the filler and wherein the filler provides at least about 90% increase in flexural modulus.

3. The golf ball of claim 1, wherein the outer layer comprises at least about 80% by weight of the filler and wherein the filler provides at least about 600% increase in flexural modulus.

4. The golf ball of claim 1, wherein the carboxylic acid comprises methacrylic acid, acrylic acid or maleic acid.

5. The golf ball of claim 1, wherein the flexual modulus of the outer layer is between about 19,000 and 120,000 psi.

6. The golf ball of claim 1, wherein the flexual modulus of the outer layer is between about 30,000 and 100,000 psi.

7. The golf ball of claim 1, wherein the filler comprises barium sulfate.

8. The golf ball of claim 1, wherein the thickness of the outer layer ranges from about 0.005 inch to about 0.03 inch.

9. The golf ball of claim 8, wherein the thickness of the outer layer is about 0.015 to 0.03 inch.

10. The golf ball of claim 1, wherein the ball further comprises a cover layer and the outer layer is disposed between the core and the cover layer.

11. The golf ball of claim 1, wherein the filler increases the rotational moment of inertia of the ball.

12. A golf ball comprising a core encased by an outer cover layer wherein the outer cover layer comprises a non-ionomeric thermoplastic matrix copolymer of ethylene and a carboxylic acid comprising methacrylic acid, acrylic acid or maleic acid, the material having a flexural modulus from about 500 psi to about 30,000 psi and at least about 50% by weight a filler, wherein the filler provides at least about 90% increase in the flexural modulus of the thermoplastic matrix from the same material in an unfilled state and wherein the acid level ranges from about 3% to about 25%.

13. The golf ball of claim 12, wherein the outer cover layer comprises at least about 80% by weight of the filler and wherein the filler provides at least about 600% increase in flexural modulus in the unfilled thermoplastic matrix.

14. The golf ball of claim 12, wherein the filler comprises barium sulfate.

15. The golf ball of claim 12, wherein the thickness of the outer layer ranges from about 0.005 inch to about 0.030 inch.

* * * * *